US008021012B2

(12) United States Patent
Dunbar

(10) Patent No.: US 8,021,012 B2
(45) Date of Patent: Sep. 20, 2011

(54) ASSEMBLY FOR DOORWAY ILLUMINATION

(76) Inventor: Tracy Dunbar, Columbus, KS (US)

( * ) Notice: Subject to any disclaimer, the term of this patent is extended or adjusted under 35 U.S.C. 154(b) by 313 days.

(21) Appl. No.: 12/467,911

(22) Filed: May 18, 2009

(65) Prior Publication Data

US 2010/0289434 A1 Nov. 18, 2010

(51) Int. Cl.
*E05B 17/10* (2006.01)

(52) U.S. Cl. ..... 362/100; 362/190; 362/205; 362/396; 362/802; 200/60

(58) Field of Classification Search ..... 200/60; 315/320; 362/100, 155, 190, 191, 205, 396, 362/501, 802
See application file for complete search history.

(56) References Cited

U.S. PATENT DOCUMENTS

| | | | | |
|---|---|---|---|---|
| 1,996,389 | A * | 4/1935 | Smith | 200/60 |
| 2,774,860 | A | 12/1956 | Prebol et al. | |
| 2,813,195 | A | 11/1957 | Willey | |
| 3,787,677 | A | 1/1974 | Molitor | |
| 4,442,478 | A | 4/1984 | Stansbury | |
| 4,475,067 | A | 10/1984 | Rowe | |
| 4,754,376 | A | 6/1988 | Winslow | |
| 4,872,095 | A | 10/1989 | Dubak | |
| 5,032,957 | A | 7/1991 | Canfield | |
| 5,246,285 | A | 9/1993 | Redburn et al. | |
| 5,685,630 | A | 11/1997 | Herman | |
| 5,717,179 | A | 2/1998 | Meyer | |
| 7,180,021 | B2 | 2/2007 | Birdwell et al. | |
| 7,347,583 | B2 | 3/2008 | Britt | |

FOREIGN PATENT DOCUMENTS

| | | |
|---|---|---|
| JP | 8264001 | 10/1996 |

* cited by examiner

*Primary Examiner* — Stephen F Husar
(74) *Attorney, Agent, or Firm* — Kenneth H. Jack; Davis & Jack, L.L.C.

(57) ABSTRACT

An assembly for doorway illumination, the doorway having a door jamb and a door, the assembly for doorway illumination including an electrical circuit having first, second, and third electrical switches, the first and second electrical switches, upon closure of the third electrical switch, being electrically parallel to each other, and the first and second electrical switches, upon opening of the third electrical switch, being electrically isolated from each other; a base supporting the first switch; a door contacting spring biased push button adapted for alternatively closing and opening the first electrical switch; an electric torch including the second electrical switch; a plurality of "C" clips adapted for alternatively attaching and releasing the electric torch to and from the base; and a plurality of electrical contacts adapted for, upon the alternative torch attaching and releasing, alternatively closing and opening the third electrical switch.

14 Claims, 6 Drawing Sheets

ASSEMBLY FOR DOORWAY ILLUMINATION

FIELD OF THE INVENTION

This invention relates to apparatus and assemblies for portable illumination and for illumination at exterior doorways of residences.

BACKGROUND OF THE INVENTION

Occupants of residential structures often leave their residence during daylight hours and later return to their home during the darkness of night time. In such circumstances, the exterior doorway of the home is often dark, making it difficult for the occupant to select an appropriate entry key and to properly manipulate locks, knobs, and latches for entry into the home. Upon successfully opening such darkened entry door at such residence, such occupant may on occasion finds that a power outage has occurred, and that hard wired electrical lights within the residence are inoperable. In such circumstances, the occupant often has difficulty entering and walking through the house in search of a portable electric flashlight or in search of a candlestick and matches.

The instant inventive assembly for doorway illumination solves or ameliorates problems discussed above by providing a specialized electric torch and related structures and assemblies which automatically illuminate a residential exterior doorway's entry knob, latch, or lock upon opening of an associated exterior screen door or storm door, and which further provide a readily accessible and useable portable electric torch carriage and used by the occupant within a darkened house.

BRIEF SUMMARY OF THE INVENTION

The instant inventive assembly for doorway illumination is preferably utilized upon or within a residence's exterior doorway. Preferably, such doorway comprises a peripheral wooden door jamb, an inner inwardly opening door which is hingedly mounted upon such door jamb, and an outer outwardly opening storm door or screen door which is similarly hingedly mounted within or upon such door jamb.

Electrical components of the instant inventive doorway illumination assembly comprise first, second, and third electrical switches. Such switches are preferably oriented and are functionally arranged with respect to each other so that upon closure of the third electrical switch, the first and second electrical switches are in an electrically parallel arrangement with respect to each other, and upon alternative opening of the third electrical switch, the first and second electrical switches are electrically isolated from each other.

A further component of the instant inventive assembly comprises a base member, the first electrical switch being mounted upon or supported by the base member. In a preferred embodiment, the base member comprises a plastic mounting plate or mounting frame having a flat outer face suitable for abutting attachment to the flat inner face of the door jamb.

A further structural component of the instant inventive assembly for doorway illumination comprises first mounting means which are preferably adapted for attaching the base member to the inner surface of the door jamb. In a preferred embodiment, the first mounting means comprises a screw and screw receiving aperture combination, the apertures of such combination being fitted for receiving screws and extending through the base member. Where such first mounting means are provided, wood screws are preferably extended through the base member's apertures for threaded mounting upon the typically wooden door jamb. Suitably, the first mounting means may alternatively comprise contact pads for adhesively attaching the base member to the door jamb. Other known means for mounting base plate type structures upon flat surfaces are considered to fall within the scope of the invention.

A further component of the instant inventive assembly comprises first actuating means which are adapted for, upon attachment of the base member to the door jamb, and upon alternative opening and closing of the outer door, alternatively closing and opening the first electrical switch which is supported by the base member. In a preferred embodiment, the first electrical switch is spring biased to a normally closed position, and the first actuating means comprises a pressure button or shaft whose distal end extends outwardly from the doorway for compressive contact and inward switch opening motion upon closure of the outer door.

A further component of the instant inventive assembly comprises an electric flashlight or electric torch which preferably and conventionally comprises at least a first electric storage battery, an illuminator such as an incandescent bulb, a light emitting diode, or a florescent bulb, and a single throw electrical "on/off" switch, such switch comprising the second electrical switch of the inventive assembly.

A further structural component of the instant inventive assembly comprises second mounting means which are adapted for alternatively attaching and holding the electric torch upon the base member, and releasing the electric torch from the base member. In a preferred embodiment, the second mounting means comprises a pair of electrically conductive "C" clips. Suitably, the second mounting means may be alternatively configured as an electric torch supporting hook. Other commonly known brackets, support cradles, and the like which are capable of releasably securing an electric torch upon a base member are considered to fall within the scope of the invention.

A further component of the instant inventive assembly for doorway illumination comprises second actuating means which are adapted for, upon such alternative attachment and release of electric torch to and from the base member, alternatively closing and opening the third electrical switch. According to the preferred function of the second actuating means, attachment of the electric torch to the base member via the second mounting means effects a closure of the third electrical switch, placing the first and second electrical switches in a parallel electrical orientation with respect to each other. Upon such torch mounting receipt and third electrical switch closure, and upon opening of the electric torch's second electrical switch, the first electrical switch advantageously bypasses the second and controls the "on/off" function of the electrical torch. Such bypassing circuitry advantageously allows the first electrical switch to control the function of the torch via alternating opening and closing of the outer door.

In a preferred embodiment of the instant invention, the third electrical switch comprises two pairs of electrical contacts (one of the pairs of electrical contacts being at opposite polar ends of the first electrical switch and the other pair of electrical contacts being at opposite polar ends of the second electrical switch), such electrical contact pairs being positioned to alternatively contact each other and disconnect from each other upon alternative attachment and release of the electric torch to and from the base member. The assembly's preferred capability for alternatively mounting and releasing the electric torch to and from the mounting plate comprises a preferred second actuating means for closing and opening the third electrical switch. Other commonly known electrical switch configurations of the third electrical switch are considered to fall within the scope of the invention.

In use of the instant inventive assembly, and assuming provision of the preferred structures as described above, a residential occupant may initially utilize wood screws to fasten the base member to an interior surface of a door jamb of the front entry door of the occupant's residence. Preferably, the base member is installed upon such door jamb between the doorway's inner door and outer storm door and at an elevation above the inner door's lock and door latch. The base member is also preferably installed so that its preferred spring biased actuator button extends outwardly for compressive contact with the outer door upon closure of the outer door. Upon such base member installation, the electrical torch's on/off switch (i.e., the assembly's second switch) may be moved to its "off" position, and the electric torch may be mounted upon the base member. Such mounting acts as a second actuating means, closing the third electrical switch by causing the assembly's electrical contact pairs to come into contact with each other. Upon achieving such configuration, and upon opening the outer door, the electric torch advantageously turns on, illuminating the inner door's knob and lock. The electric torch advantageously automatically turns off upon closure of the outer storm or screen door.

In the event that the occupant of the residence finds the interior of the house dark as a result of a power failure, the occupant may simply and conveniently withdraw the electric torch from the base member's "C" clips and may manually move the second electrical switch to its "on" position. Thereafter, the occupant may utilize the electric torch in a conventional fashion for illuminating interior spaces within the residence.

Accordingly, it is an object of the instant invention to provide an assembly for doorway illumination which incorporates structures and components as described above, and which arranges those structures and components for the performance of beneficial functions as described above.

Other and further objects, benefits, and advantages of the instant invention will become known to those skilled in the art upon review of the Detailed Description which follows, and upon review of the appended drawings.

DETAILED DESCRIPTION OF A PREFERRED EMBODIMENT

Figure 1:
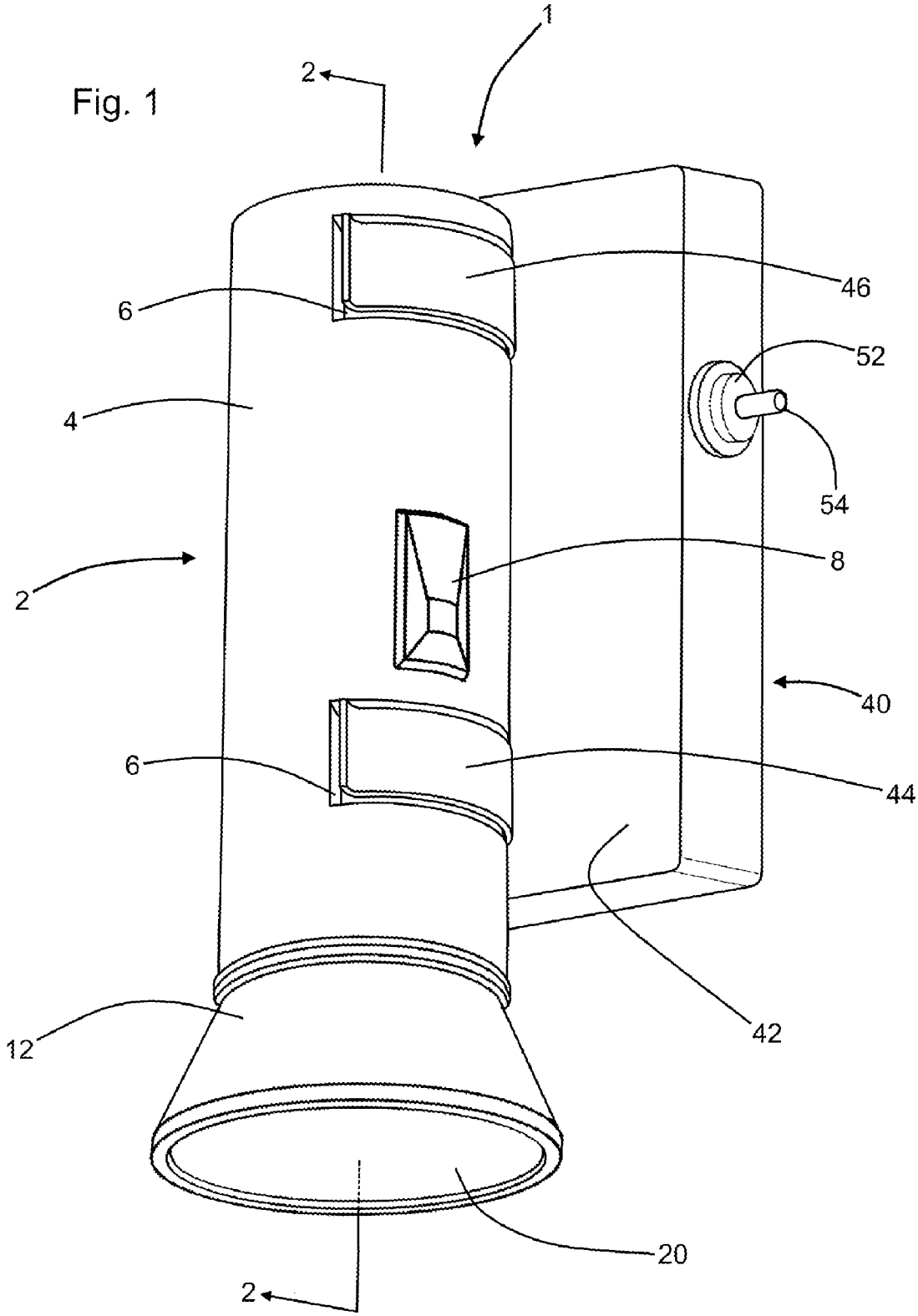
FIG. 1 is a perspective view of a preferred embodiment of the instant inventive assembly for doorway illumination.
Figure 2:
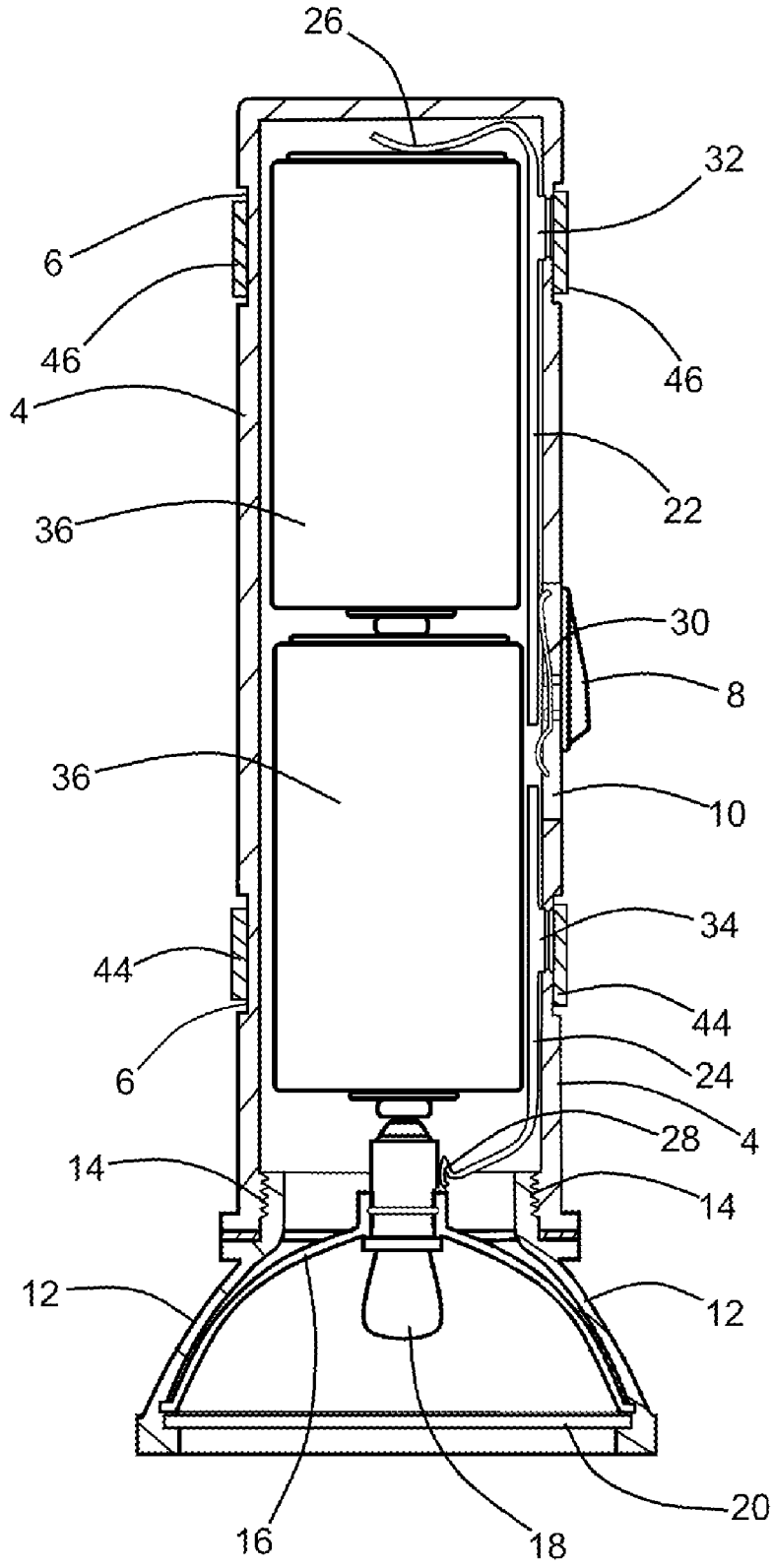
FIG. 2 is a sectional view as indicated in FIG. 1.
Figure 3:
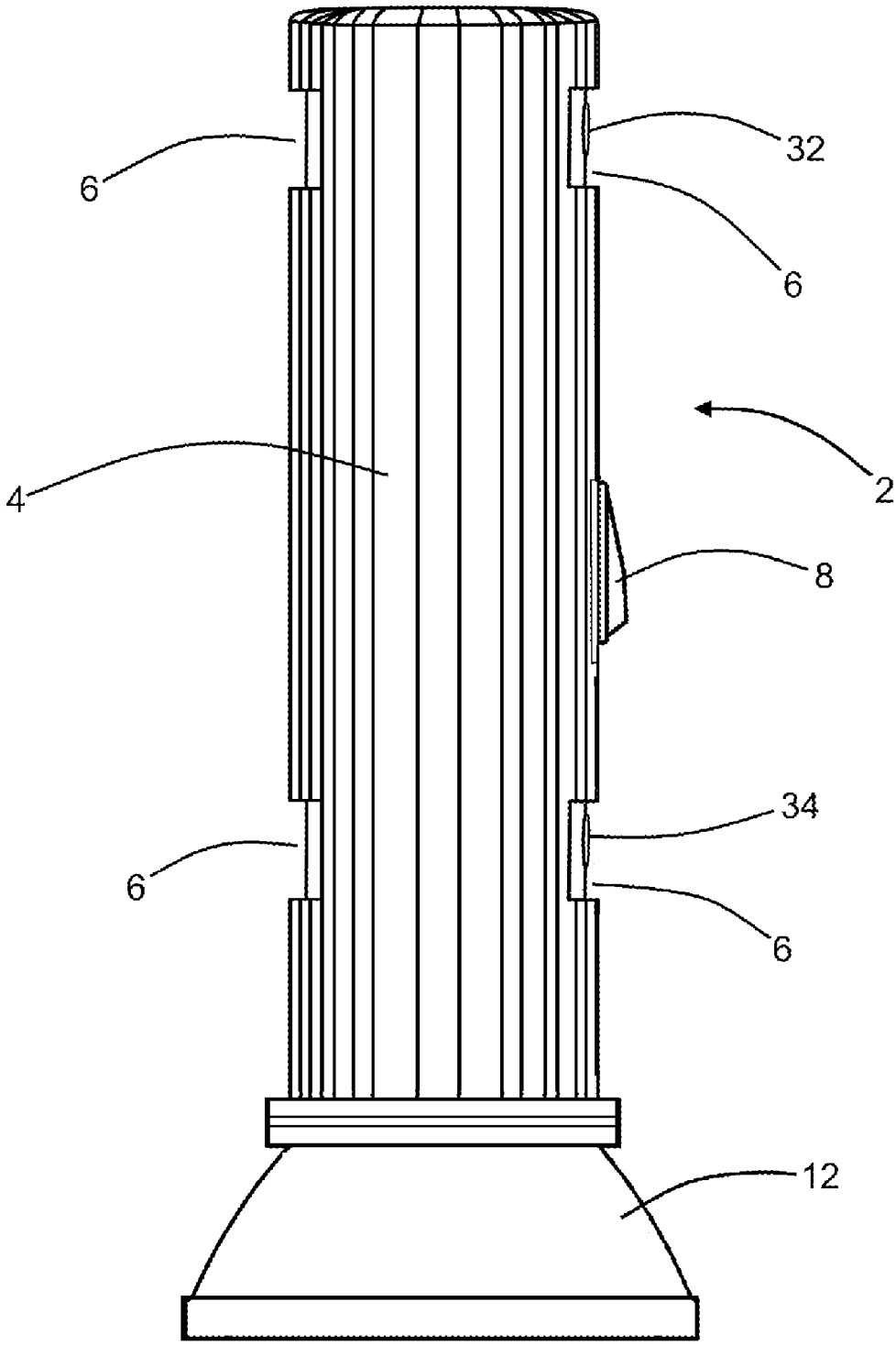
FIG. 3 is a side view of an electric torch component of the instant assembly, the electric torch shown removed from the base assembly of FIG. 1.

Referring now to the drawings, and in particular to FIGS. 1, 2, and 3, a preferred embodiment of the instant inventive assembly for doorway illumination is referred to generally by Reference Arrow 1. The assembly 1 preferably comprises a specially configured and adapted electric torch or flashlight which is separately referred to generally by Reference Arrow 2. The electric torch 2 preferably includes conventional flashlight components including a hollow handle or battery housing 4, a pair of batteries 36 housed within the battery housing 4, a reflector housing 12 mounted by helical threads 14 over the forward opening of the battery housing 4, an incandescent bulb, light emitting diode bulb, or florescent bulb 18 centrally mounted within a reflector 16, a transparent lens 20 covering the reflector 16, electrical conductors, battery and bulb contacts 22, 24, 26, and 28 which form in combination with the batteries and bulb a loop circuit, and a single throw, on/off switch 8,30 which slidably moves within side wall slot 10.

Referring further simultaneously to FIGS. 1, 2, and 3 specialized and non-conventional features of the electric torch 2 preferably comprise upper and lower "C" clip receiving channels 6 and contacts 32 and 34. For purposes and functions further discussed below, the electrical contacts 32 and 34 preferably extend through the battery housing wall 4 to emerge and to be exposed for electrical contact within the channels 6.

Figure 6:
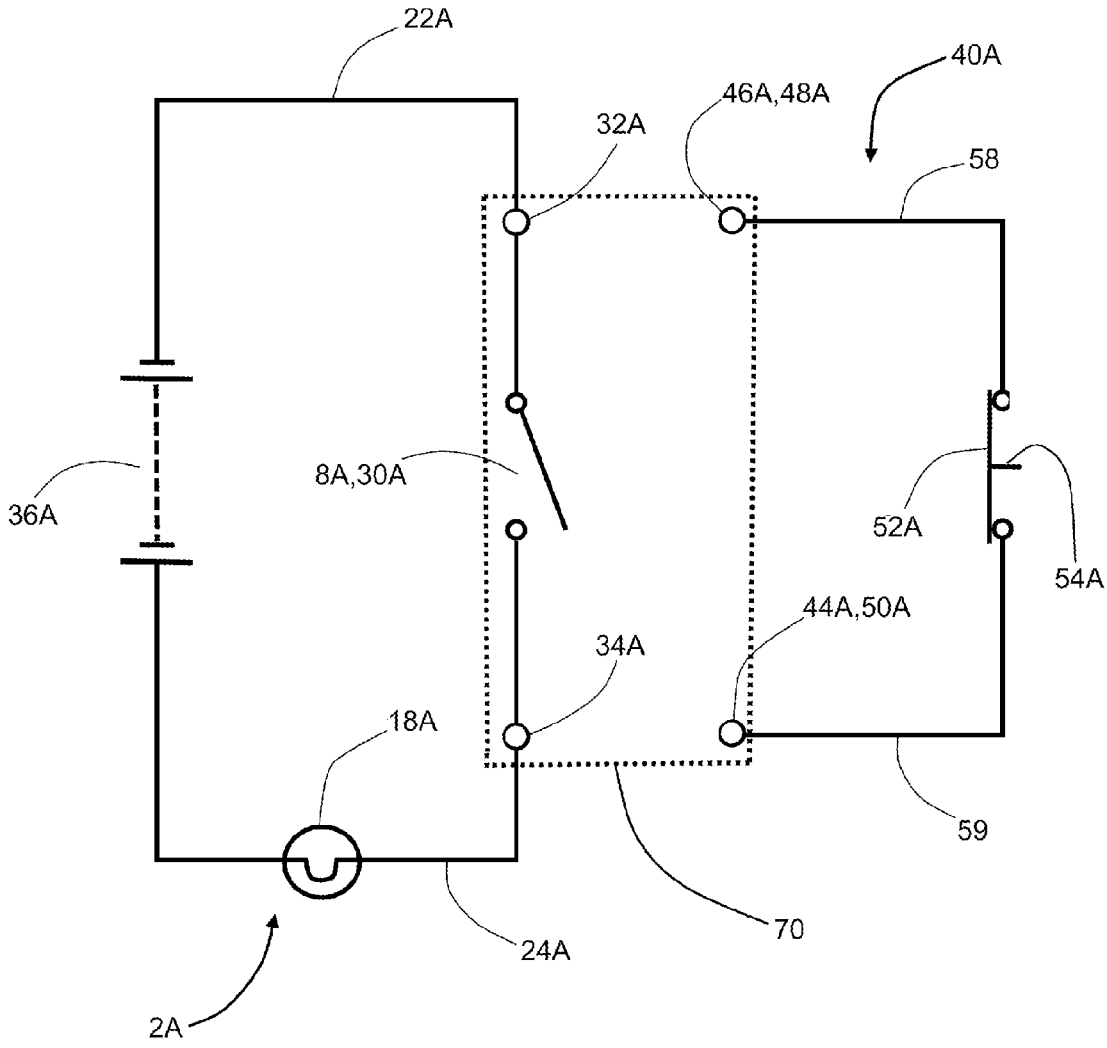
FIG. 6 is an electrical schematic diagram representing preferred electric circuit components of the instant invention.

Referring simultaneously to all figures, reference numerals in FIG. 6 having a suffix "A" representationally correspond with similarly numbered structures appearing in other drawings. For example, the electric sub-circuit 2A represents the portion of the instant invention's electric circuit which resides within torch 2, such electric sub-circuit 2A preferably having in a loop series including a contact point 32A, a single throw electric switch 8A, 30A, a contact point 34A, a conductor 24A, an illuminator 18A, a battery series 36A, and a conductor 22A.

Figure 4:
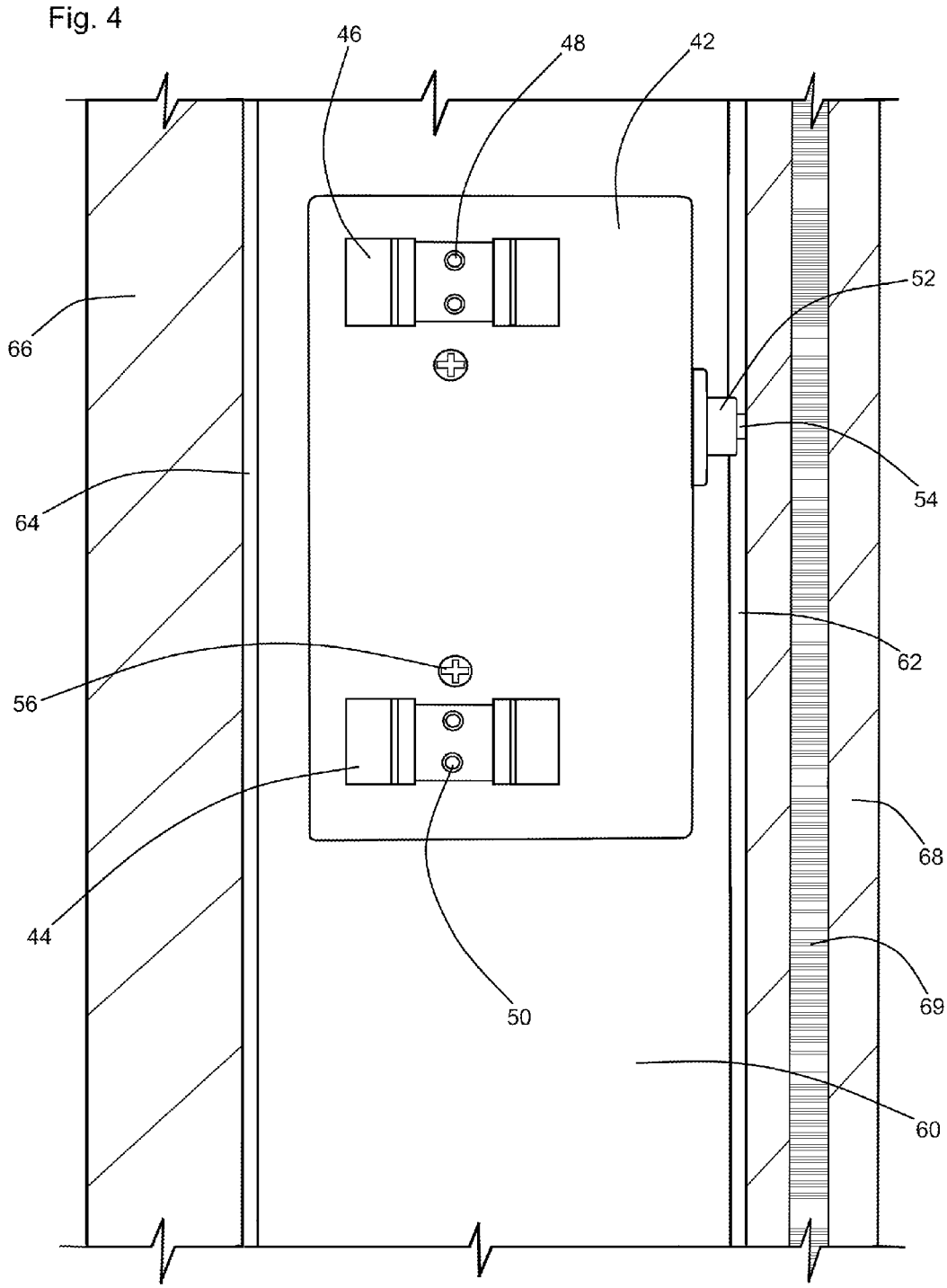
FIG. 4 is a plan view of the base assembly component of the instant inventive assembly, such component shown with electric torch removed, and shown as installed upon an exemplary door jamb.

Referring simultaneously to FIGS. 1 and 4, a base mounting and door actuated switching assembly of the instant invention 1 is separately referred to generally by Reference Arrow 40. Such assembly 40 preferably comprises a base plate 42. First mounting means are preferably provided for fixedly attaching the base plate 42 to the flat interior surface of a door jamb 60. A preferred first mounting means comprises a pair of wood screws 56 which extend through apertures within the base plate 42 for threaded engagement within the door jamb 60.

Referring simultaneously to FIGS. 1, 4 and 6, the base plate 42 preferably supports and outwardly positions a single throw on/off switch or first switch 52, the torch's switch 8 being referred to herein as a second switch. The doorway mounted first switch 52 preferably incorporates first actuating means in the form of an outwardly extending push button contact member 54. The first switch 52 preferably normally spring biases the actuating push button 54 outwardly, normally closing the first switch 52. Conductors or wires 58 and 59 are preferably attached electrically to the opposite poles of the first switch 52, such conductors preferably extending through the body of the base plate 42 to attach electrically to "C" clips 46, and 44, which are mounted upon the base plate 42 by rivets 48 and 50. As a result of such electrical connections, the "C" clips 46 and 44 advantageously function as second mounting means capable of releasably receiving the electric torch 2, and functioning as a second pair of electrical contacts.

Referring simultaneously to FIGS. 1, 2, 4, and 6, the torch's first pair of electrical contacts 32 and 34 in combination with the base assembly's pair of electrical contacts/"C" clips 46 and 44 advantageously comprise and function as a third switch component of the instant invention. Referring in particular to FIG. 6, the dotted line box 70 encompasses contacts 32A, 34A, 46A, and 44A, and represents the invention's third electrical switch. Second actuating means are preferably provided for alternatively opening and closing the third electrical switch 70. The second actuating means preferably comprises the combination of the torch's channels 6 which are fitted for receiving "C" clips 46 and 44, the outward exposures of the torch's contacts 32 and 34 within such channels for electrical contact with such clips, and the clips' dual function as electrical contacts. Upon operation, the second actuating means alternatively closes and opens the third electric switch 70 via alternative mounting of the electric torch 2 within the "C" clips 44 and 46 and removal of the torch from the clips. Upon closure of the third switch 70, the electric torch's on/off switch 8, 30, and the mounting plate's electric switch 52 become electrically parallel with respect to each other, advantageously allowing a closure of the mounting plate's switch 52 to bridge the electric torch's switch 8, 30 and to actuate the illuminator 18 while the torch's switch 8, 30 remains open. Alternative removal of the electric torch 2 from the "C" clips 44 and 46 opens the third switch 70 by isolating the "C" clip contact points 46 and 44 from the torch's electric contact points 32 and 34.

Referring simultaneously to all figures, the instant inventive assembly for doorway illumination is preferably mounted upon and utilized at an exterior doorway comprising a peripheral door jamb 60, having a hingedly mounted inner door 66, and a hingedly mounted outer storm door 68. The outer storm door 68 typically supports a transparent glass pane 69, and the inner door 66 typically has a lock mechanism 72. Insulation strips 62 and 64 are provided for weather sealing the doors 66 and 68. In use of the instant inventive assembly, an occupant of a residence including the exterior doorway depicted in FIGS. 4 and 5 may initially mount the mounting plate 42 upon the interior surface of the door jamb 60 utilizing wood screws 56. Preferably, such mounting positions the mounting plate 42 above the lock 72 and at a lateral side of the doorway which is opposite the door's hinges. (Hinges not depicted within views). Also, preferably, the mounting plate 42 is situated upon the door jamb 60 so that, upon opening of the outer storm door 68, the distal or outer end of the push button actuator 54 of the first switch 52 extends outwardly, slightly beyond the outer edge of insulation strip 62. Referring further simultaneously to FIG. 6, upon closure of the outer storm door 68, the inner surface of such door presses against the outer distal end of the push button actuator 54, opening the switch 52, and breaking electrical communication between the electrical contact "C" clips 44 and 46. Alternatively, opening of the outer storm door 68 allows the biasing spring of the switch 52 to move the actuator 54 outwardly, returning the switch 52 to its normally spring biased and closed position. Accordingly, opening of the door 68 establishes an electrically conductive path between "C" clips 44 and 46.

Figure 5:
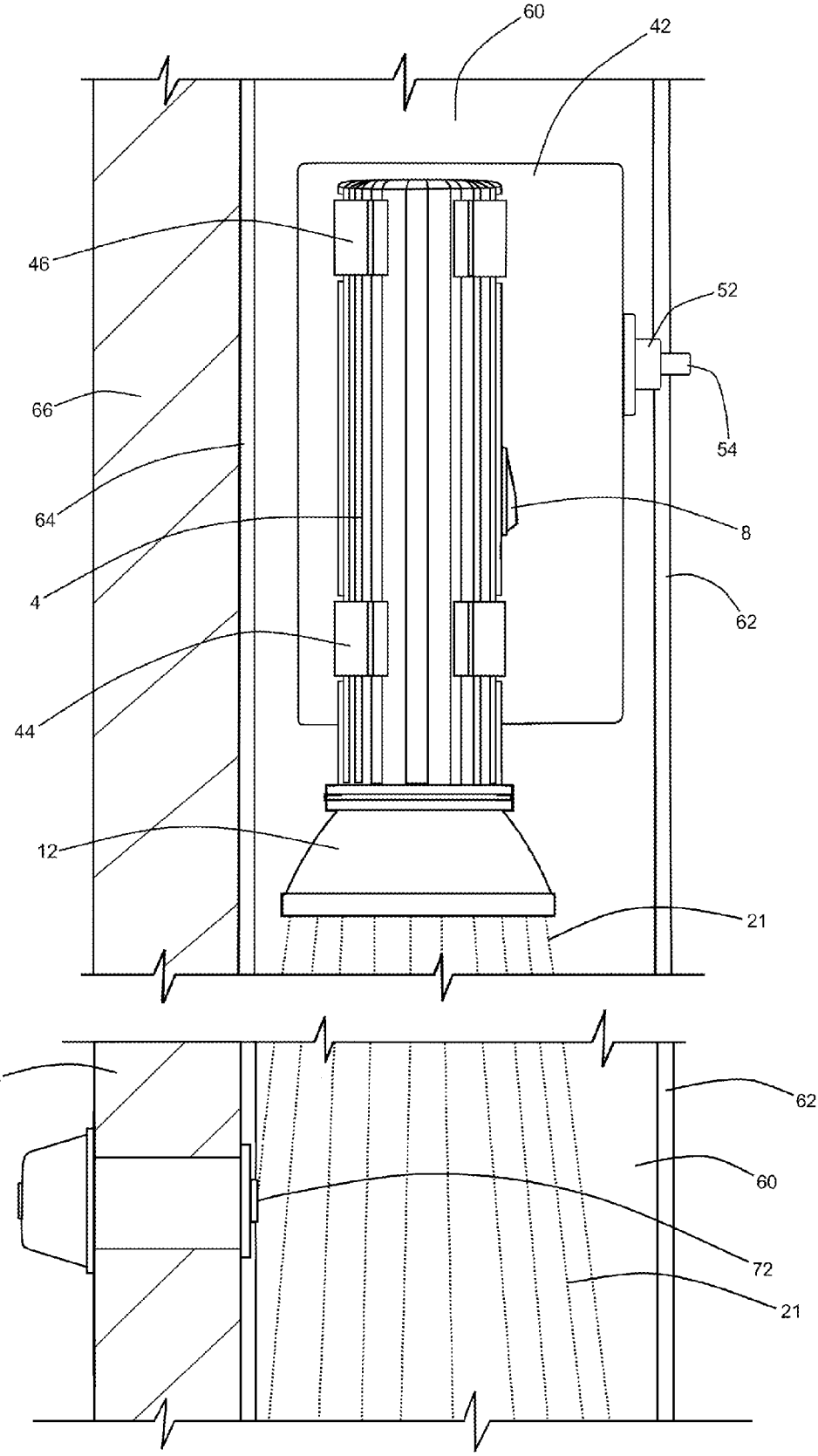
FIG. 5 redepicts FIG. 4, the view of FIG. 5 showing the doorway's outer storm door opened, and additionally showing an underlying inner door lock.

Following the occupant's installation of the base plate 42 upon the door jamb 60 as described above, the occupant may, referring simultaneously to FIGS. 3, 4, and 5, grasp the torch 2, may move the torch's switch 8 to its "off" position, and may position the torch so that its side wall channels 6 align with "C" clips 46 and 44. Thereafter, such occupant may manually press the electric torch 2 into the "C" clips 44 and 46, causing each of the "C" clips' arms to nest within one of the channels 6, and causing the "C" clips to securely hold and suspend the electric torch 2.

The "C" clips 44 and 46 are preferably composed of electrically conductive spring steel, and upon their third switch actuating receipt of the electric torch 2, inner surfaces of such clips 44 and 46 directly contact the torch's electric contacts 34 and 32. Such electrical contacts serve to close the third electric switch 70 and to cause the torch's second electric switch 8, 30 and the base plate's first electric switch 52 to be arranged electrically parallel with respect to each other. Assuming that the electric torch's second switch 8, 30 is in its off position, receipt of the electric torch 2 within clips 46 and 44 bypasses the second switch 8 and allows the first electric switch 52 to control the electric torch's on/off function. Accordingly, upon opening of the second electric switch 8, 30, upon receipt of the electric torch 2 within clips 44 and 46, and upon resultant closure of the third electric switch, alternative opening and closing of the outer storm door 68 alternatively activates and deactivates the electric torch 2.

Preferably, the base plate 42 and the electric torch 2 are positioned as shown in FIG. 5 so that upon opening of the outer storm door 68, light 21 from the torch 2 casts downwardly over lock 72, making it easier for the occupant to find and utilize a key for such lock in darkness. In the event that interior lights within the residence are not functioning, such occupant may simply manually extract the electric torch 2 from clips 44 and 46 and may utilize the electric torch 2 within the interior of the residence in a conventional fashion.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. An assembly for doorway illumination, the doorway comprising a door jamb, an inner door hingedly mounted within the door jamb, and an outer door hingedly mounted within the door jamb, the inner door having a lock, the assembly for doorway illumination comprising:

(a) an electrical circuit comprising first, second, and third electrical switches, the first and second electrical switches, upon closure of the third electrical switch being electrically parallel to each other, and the first and second electrical switches, upon opening of the third electrical switch, being electrically isolated from each other;

(b) a base supporting the first electrical switch;

(c) first mounting means adapted for attaching the base to the door jamb;

(d) first actuating means adapted for, upon the attachment of the base to the door jamb and upon alternative opening and closing of the outer door, alternatively closing and opening the first electrical switch;

(e) an electric torch comprising the second electrical switch;

(f) second mounting means adapted for alternatively attaching and releasing the electric torch to and from the base; and (g) second actuating means adapted for, upon the alternative torch attaching and releasing, alternatively closing and opening the third electrical switch.

2. The assembly for doorway illumination of claim 1 wherein the electrical circuit further comprises an illuminator and at least a first battery, the illuminator and the at least first battery being housed within the electric torch.

3. The assembly for doorway illumination of claim 2 wherein the illuminator is selected from the group consisting of incandescent bulbs, light emitting diodes, and florescent bulbs.

4. The assembly for doorway illumination of claim 1 wherein the first electrical switch is spring biased to a normally closed position.

5. The assembly for doorway illumination of claim 4 wherein the first actuating means comprises a push button having a door contacting distal end.

6. The assembly for doorway illumination of claim 1 wherein the second mounting means comprises at least a first torch grasping member.

7. The assembly for doorway illumination of claim 6 wherein the at least first torch grasping member comprises a "C" clip.

8. The assembly for doorway illumination of claim 7 wherein the second mounting means further comprises a second "C" clip.

9. The assembly for doorway illumination of claim 1 wherein the third electrical switch comprises first and second pairs of electrical contacts, the first pair of electrical contacts being connected electrically at opposite polar ends of the first electrical switch, and the second pair of electrical contacts being connected electrically at opposite polar ends at the second electrical switch.

10. The assembly for doorway illumination of claim 9 wherein the alternative closure and opening of the third electrical switch alternatively electrically communicates and isolates the first and second pairs of electrical contacts with and from each other.

11. The assembly for doorway illumination of claim 10 wherein the first pair of electrical contacts comprises electrical conductive "C" clips, the second mounting means comprising said "C" clips.

12. The assembly for doorway illumination of claim 11 wherein the electric torch comprises a housing having an outer surface, and wherein the second pair of electrical contacts are exposed at the housing's outer surface.

13. The assembly for doorway illumination of claim 12 further comprising a plurality of "C" clip arm receiving channels, the exposure of the second pair of electrical contacts being positioned within said channels.

14. The assembly for doorway illumination of claim 13 wherein the "C" clips are positioned for causing the electric torch to illuminate the inner door's lock.

* * * * *